US006026660A

United States Patent [19]

Lai

[11] Patent Number: 6,026,660

[45] Date of Patent: Feb. 22, 2000

[54] JEWELRY SETTING

[75] Inventor: Danny S. Lai, New York, N.Y.

[73] Assignee: Gramercy Enterprises Corp., New York, N.Y.

[21] Appl. No.: 08/855,175

[22] Filed: May 13, 1997

[51] Int. Cl.[7] ..... A44C 17/02

[52] U.S. Cl. ..... 63/26; 63/28

[58] Field of Search ..... 63/28, 26, 27

[56] References Cited

U.S. PATENT DOCUMENTS

| | | | |
|---|---|---|---|
| 483,214 | 9/1892 | Gaynor | 63/26 X |
| 1,211,240 | 1/1917 | Ryan | 63/26 |
| 1,854,958 | 4/1932 | Santosuosso | 63/28 |
| 1,863,617 | 6/1932 | Brogan | 63/26 X |
| 2,141,363 | 12/1938 | Rigollet | 63/26 X |
| 4,222,245 | 9/1980 | Vitau | 63/28 |
| 4,392,289 | 7/1983 | Michaud | 29/160.6 |
| 4,400,932 | 8/1983 | Epstein | 63/28 X |
| 4,731,913 | 3/1988 | Plantureux et al. | 63/28 X |
| 4,813,246 | 3/1989 | Richards | 63/26 |
| 4,835,987 | 6/1989 | Magnien et al. | 63/28 |
| 5,090,217 | 2/1992 | Beber et al. | 63/27 |
| 5,115,649 | 5/1992 | Amber | 63/26 |
| 5,188,679 | 2/1993 | Kretchmer | 63/26 X |
| 5,218,839 | 6/1993 | Udko | 63/26 |
| 5,437,167 | 8/1995 | Ambar | 63/26 |
| 5,680,776 | 10/1997 | Shenav | 63/26 |
| 5,755,117 | 5/1998 | Shenav | 63/26 |
| 5,848,539 | 12/1998 | Ouzounian | 63/28 |

FOREIGN PATENT DOCUMENTS

| | | | |
|---|---|---|---|
| 89906 | 9/1983 | European Pat. Off. | 63/28 |
| 557624 | 8/1923 | France | 63/28 |
| 2260966 | 9/1975 | France | 63/28 |
| 2405041 | 6/1979 | France | 63/26 |
| 180882 | 9/1962 | Sweden | 63/27 |

*Primary Examiner*—Terry Lee Melius
*Assistant Examiner*—Andrea Chop
*Attorney, Agent, or Firm*—Kenyon & Kenyon

[57] ABSTRACT

A setting for retaining at least one grooveless precious stone and a method for providing such setting. A first portion of the setting includes a first surface, with the first surface contacting a facet portion of the grooveless precious stone at a first contacting location of the at least one grooveless precious stone. A second portion of the setting cooperates with the first portion and includes a second surface. The second surface contacts a pavilion portion of the grooveless precious stone at a second contacting location of the grooveless precious stone. The pavilion portion is situated below the facet portion. The grooveless precious stone is situated between the first portion and the second portion, with the second portion being wax-molded with the grooveless precious stone to provide a first pressure on the at least one pavilion portion at the second contacting position. The first portion provides a second pressure on the facet portion at the first contacting position in response to the first pressure.

13 Claims, 5 Drawing Sheets

JEWELRY SETTING

FIELD OF THE INVENTION

The present invention relates generally to a jewelry setting and method for retaining a precious stone.

BACKGROUND OF THE INVENTION

Items of jewelry such as rings, earrings and pendants generally comprise an outer body portion adapted to be worn by the wearer. The outer item may include a setting portion which generally secures one or more precious stones or other decorative article for display. The ornamental item is normally fixedly secured to the body portion by, for example, gluing or soldering processes and cannot be easily removed or replaced with other ornamental items. The setting portion usually includes prongs or other means for holding one or more precious stones. However, the conventional holding means usually cover at least a partial area of a facet portion (or even a table portion) of the precious stone. Since the facet portion and the table portion are the most visible parts of the precious stone, it is preferable to limit the holding means from covering the facet portion and the table portion.

In the past, there have been attempts to either limit the facet and table portions of the precious stone from being covered or even remove any obstruction over the facet and table portions caused by the holding means. For example, U.S. Pat. No. 5,437,167 describes a method and apparatus for invisibly setting round precious stones. With this conventional method and apparatus, when the round diamond is placed in the setting (e.g., a barrel of the setting), the facet and table portions of the diamond are unobstructed by the setting, and the round diamond is secured within the setting. The diamond is provided with grooves cut in the diamond's belt portion. The setting includes wedge-shaped tongues projecting inward from walls of the setting. The diamond is secured in the setting by coupling the wedges of the setting with the grooves carved in the diamond. One of the disadvantages of such a method and apparatus is that the diamond must be cut (at least partially) to form the grooves in the belt portion of the diamond. Whenever diamonds are cut to form wedges therein, there exists a possible risk that the diamond may crack, thus a substantial value of the diamond may be lost. The carat weight of the diamond is also decreased when a portion of the diamond is cut to form a wedge, thus also reducing the value of the diamond. Furthermore, when wedges are cut at the belt portion (or any other portion) of the diamond, at least some of the reflective properties of the diamond are reduced, thus additionally reducing the value of the diamond (or another precious stone). One of the objects of the present invention is to provide a setting for precious stones and ornaments and a method for retaining the precious stones and ornaments, without the disadvantages of the conventional methods and settings.

SUMMARY OF THE INVENTION

A setting for retaining at least one grooveless precious stone according to the present invention includes a first portion and a second portion. The first portion includes a first surface, with the first surface contacting a facet portion of the grooveless precious stone at a first contacting location of the at least one grooveless precious stone. The second portion cooperates with the first portion and includes a second surface. The second surface contacts a pavilion portion of the grooveless precious stone at a second contacting location of the grooveless precious stone. The pavilion portion is situated below the facet portion. The grooveless precious stone is situated between the first portion and the second portion, the second portion cooperating with the grooveless precious stone to provide a first pressure on the at least one pavilion portion at the second contacting position. The first portion provides a second pressure on the facet portion at the first contacting position in response to the first pressure.

The present invention also relates to a method for retaining at least one grooveless precious stone in a setting. The setting is composed of a wax compound and includes a first portion and a second portion, with the first portion having a first surface for contacting a facet portion of the grooveless precious stone, and the second portion having a second surface for contacting at least one pavilion portion of the grooveless precious stone. The grooveless stone is first mounted in the setting between the first portion and the second portion. The setting is provided on a wax stick to form a wax tree, with the grooveless stone positioned away from the wax stick. The wax tree is inserted in a perforated flask and an investment compound is poured through the perforated flask to cover the wax tree. Then, the investment compound hardens around the wax tree. The hardened investment compound and the wax tree are heated to evaporate the wax compound, the wax tree and the first and second portions, thus forming a through-hole extending from a first end of the hardened investment compound situated at the perforated flask to a second end of the hardened investment positioned opposite to the first end of the hardened investment compound. A molten precious metal is applied at the first end of the hardened investment compound to enter the through-hole, so that the molten precious metal replaces the evaporated wax compound and the wax tree. A vacuum is then applied via the through-hole at the second end of the hardened investment compound to form a third precious metal portion and fourth precious metal portion using the molten precious metal. The third portion replaces the first portion, and the fourth portion replaces the second portion, with the third portion applying a first pressure on a facet portion of the grooveless precious stone, and the fourth portion applying a second pressure on a pavilion portion of the precious stone. Then, the hardened investment compound is removed.

DETAILED DESCRIPTION

Figure 1:
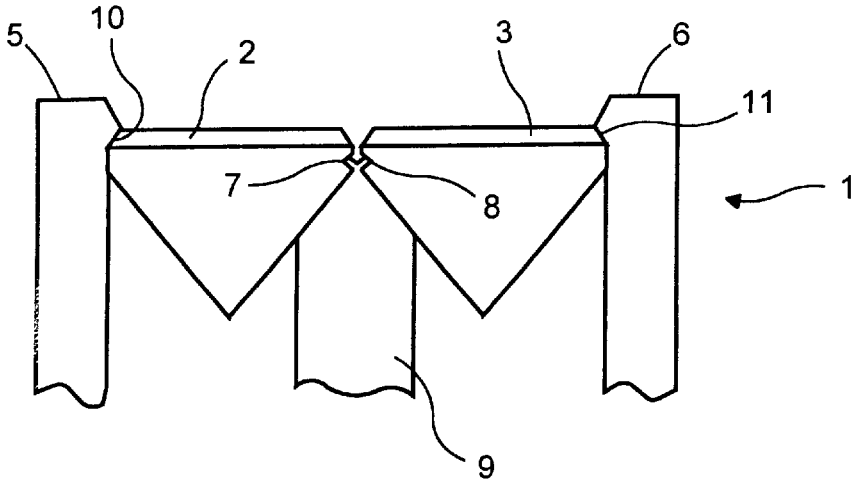
F I G. 1 PRIOR ART
FIG. 1 shows a side view of a conventional setting for securing a plurality of precious stones.
Figure 2:
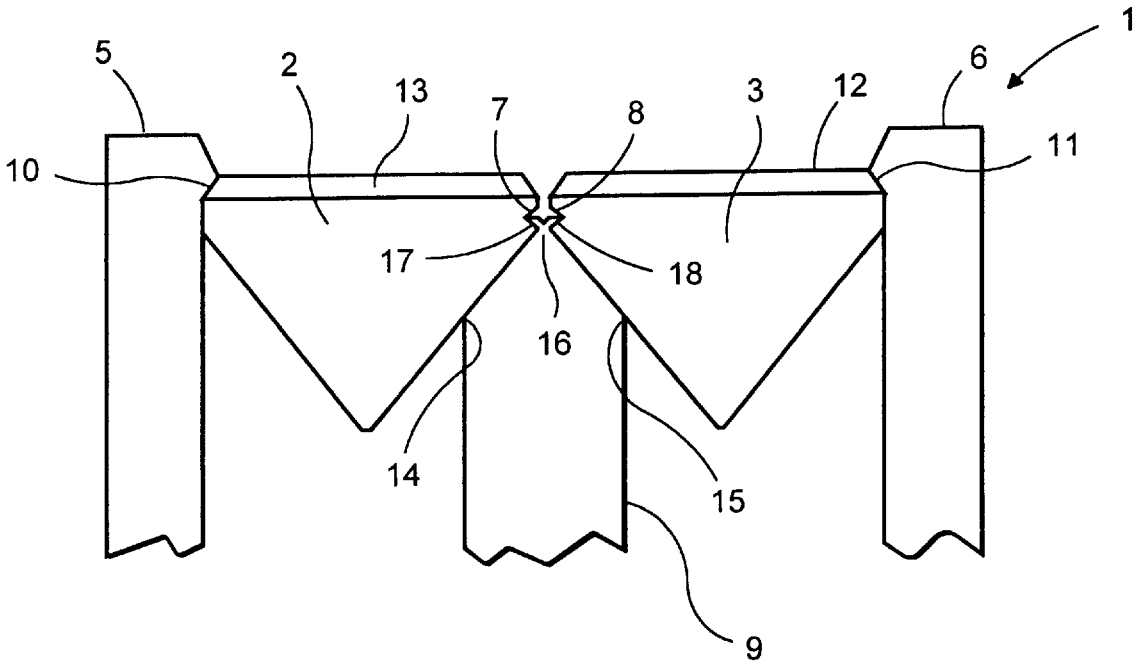
F I G. 2 PRIOR ART
FIG. 2 shows an enlarged view of the conventional setting illustrated in FIG. 1.

FIGS. 1 and 2 illustrate a side view of a conventional setting that secures a plurality of precious stones. In particular, the conventional setting 1 includes a first holding portion 5, a second holding portion 6 and a third holding portion 9. The first holding portion 5 engages with a facet portion of a first stone 2 at a first contacting position 10. The second holding portion 6 engages with a facet portion of a second stone 3 at a second contacting position 11. As seen in FIG. 2, which shows an enlarged view of the conventional setting for holding precious stones illustrated in FIG. 1, the first and second stones 2 and 3 have respective first and second wedge-shaped grooves 7 and 8. The third holding portion 9 includes a wedge member 16 having a first wedge portion 17 for inserting into the first wedge-shaped groove 7 and a second wedge portion 18 for inserting into the second wedge-shaped groove 8. Thus, by holding the respective facet portions of the first and second stones 2 and 3 with the wedge 16 of the third holding portion 9, and by contacting the first and second stones with the first and second holding portions 5 and 6 at first and second respective contacting positions 10 and 11, the first and second stones 2 and 3 are secured in the conventional setting 1.

Figure 3:
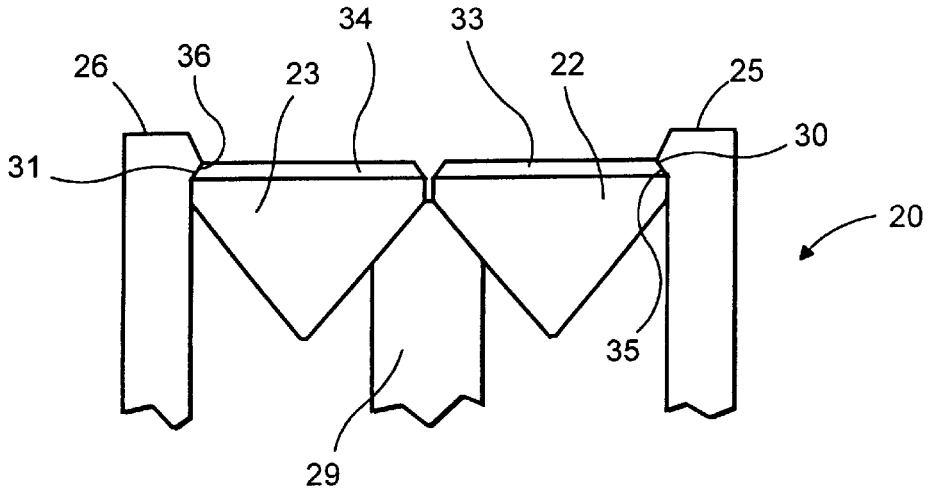
FIG. 3 shows a side view of the setting for securing a plurality of precious stones according to the present invention.

FIG. 3 shows a side view of a setting according to the present invention. The setting 20 includes a first holding portion 25, a second holding portion 26 and a third holding portion 29. The first holding portion 25 includes a first contacting portion 35 (see FIG. 4), and the second holding portion 26 includes a second contacting portion 36 (see FIG. 4). The first and second contacting portions 35 and 36 are each angled for snugly contacting the respective facet portions 33 and 34 of the first and second stones 22 and 23. In particular, the first contacting portion 35 contacts the first facet portion 33 of the first stone 22 at a first contacting position 30, and the second contacting portion 36 contacts the second facet portion 34 of the second stone 23 at a second contacting position 31. Thus, the first and second stones 22 and 23 are prevented from slipping out of the setting 20 at the first and second contacting positions 30 and 31. The first stone 22 and/or the second stone 23 are preferably princess-cut stones or beget stones, however, other stone shapes are conceivable (e.g., round stones and oval stones). Thus, e.g., at least two rows of stones may be secured on the setting 20.

Figure 4:
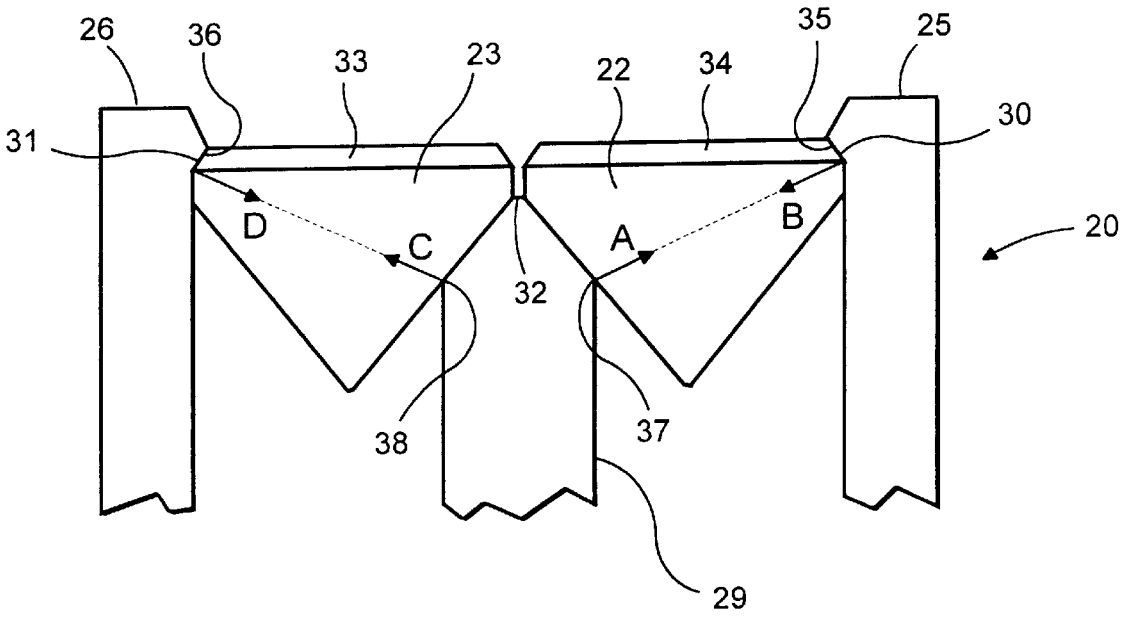
FIG. 4 shows an enlarged view of the setting according to the present invention as illustrated in FIG. 3.

FIG. 4 shows an enlarged view of the setting according to the present invention as illustrated in FIG. 3. Unlike the stones 5 and 6 shown in FIGS. 1 and 2, the first and second stones 22 and 23 do not have any grooves. In addition, the third holding portion 29 does not require any wedges since there are no grooves present in the first and second stones 22 and 23. In order to secure the first and second stones 22 and 23, the third holding portion 29 must be utilized in such a way as to prevent the first and second stones 22 and 23 from sliding out of the setting 20 according to the present invention. Thus, the third holding portion 29 applies a first force (or pressure) A at a third contacting portion 37 of the first stone 22 (i.e., at a pavilion portion of the first stone 22). When the first force A is exerted by the third holding portion 29 at the third contacting position 37, a second force (or pressure) B is therefore exhibited substantially at the first contacting position 30 for counteracting the first force A. The third holding portion further applies a third force (or pressure) C at a fourth contacting portion 38 of the second stone 23 (i.e., at a pavilion portion of the second stone 23), and therefore, a fourth force (or pressure) D is exhibited substantially at the fourth contacting position 31 for counteracting the third force C.

The setting 20 (and especially the third contacting portion 29) are preferably provided using a wax casting method according to the present invention. In particular, the third contacting portion 29 may be wax casted so that the first and third forces A and C (cooperating with the second and fourth forces B and D) act to secure the first and second stones 22 and 23, without the necessity to etch a groove in the first and second stones 22 and 23. Accordingly, each of the first and second stones 22 and 23 are held securely in place only using the forces A through D which are exerted on the first and second stones 22 and 23 by the first, second and third contacting portions 25, 26 and 29.

It is preferable for the third contacting portion 29 to apply the first force A at a centroid position below a belt portion and on an opposite side from the first contacting position 30 of the first stone 22, and to apply the second force B at a centroid position below a belt portion and on an opposite side from the second contacting position 31 of the second stone 23. Therefore, the first force A is substantially equal and opposite to the second force B, and the third force C is substantially equal and opposite to the fourth force D.

Figure 5:
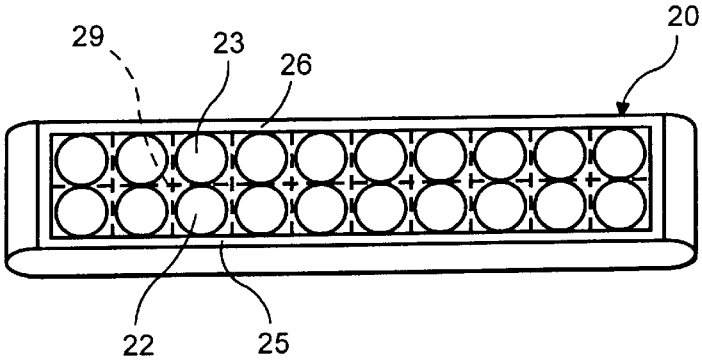
FIG. 5 shows an embodiment of the setting including two rows of diamonds according to the present invention.

A plan view of an exemplary setting 20 according to the present invention is shown in FIG. 5. The setting is FIG. 5 includes two rows of the precious stones, which are secured using the setting and method according to the present invention.

Figure 6:
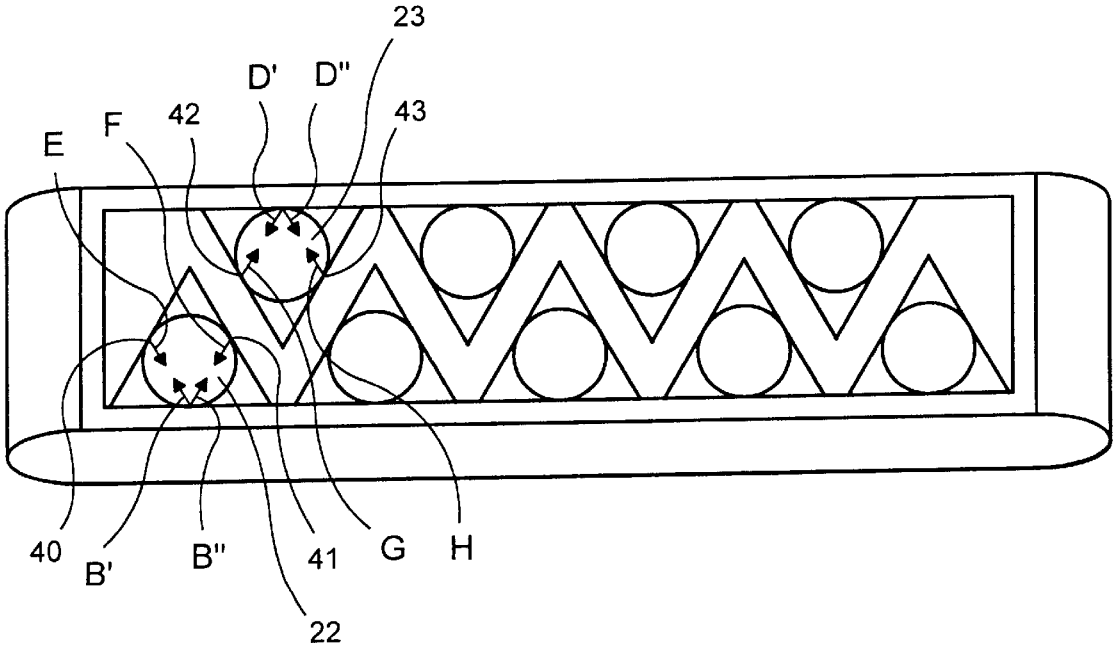
FIG. 6 shows another embodiment of the setting according to the present invention.

Further embodiments of the setting according to the present invention are possible. For example, FIG. 6 shows a setting having a fourth, a fifth, sixth and seventh contacting portions 40, 41, 42 and 43 (instead of the third contacting portion 29 shown in FIGS. 3 and 4). The fourth contacting portion 40 exerts a fifth force E, and the fifth contacting portion 41 exerts a sixth force F. The fifth and sixth forces E and F (instead of the first force A) counteract second forces B' and B". The sixth contacting portion 42 exerts a seventh force G, and the seventh contacting portion 43 exerts an eighth force H. The seventh and eighth forces G and H (instead of the first force A) counteract fourth forces D' and D".

Figure 7:
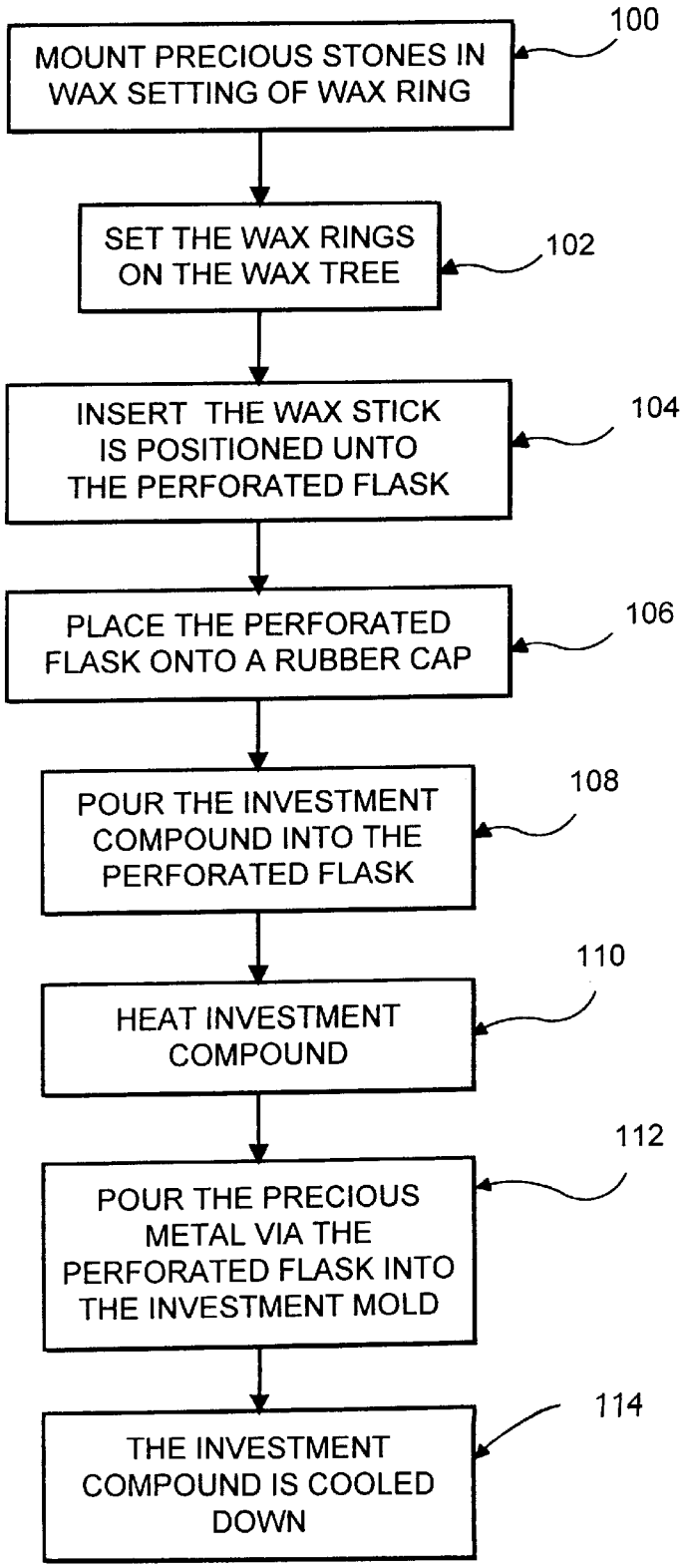
FIG. 7 shows a sequence of method steps of the method for setting a plurality of precious stones according the present invention.
Figure 8:
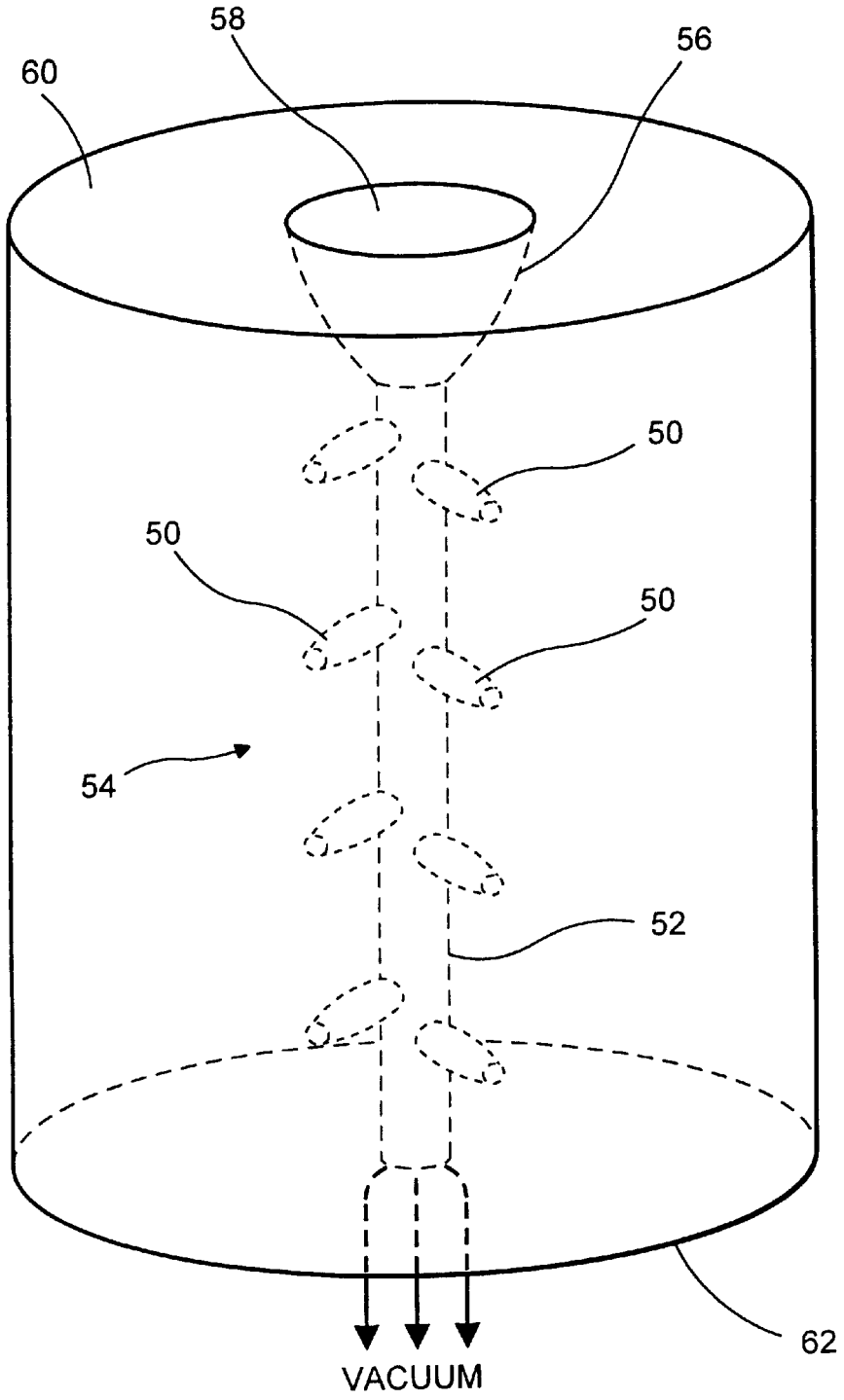
FIG. 8 shows an arrangement for manufacturing a setting using a method according to the present invention.

FIG. 7 shows a sequence of method steps for manufacturing a setting according to the present invention. It is preferable for the setting (as well as the ring) to be manufactured from a master as a wax piece, with the precious stones being inserted into the wax piece. In step 100, the precious stones are mounted in the wax pieces 50 (See FIG. 8). In step 102, the wax pieces 50 (with the precious stones therein) are positioned on a wax stick 52, thus forming "a wax tree" 54 (see FIG. 8). The precious stones are preferably positioned away from the wax stick 52. In step 104, the wax stick 52 (having the wax pieces 50 thereon) is placed unto a perforated flask 56 (see FIG. 8). In step 106, the perforated flask 56 is placed onto a rubber cap to seal one end of the perforated flask 56. In step 108, an investment compound is poured into the perforated flask 56, thus covering the wax tree 54, the wax rings, wax settings and the respective precious stones with the investment compound. The investment compound hardens around the wax tree 54, wax rings 50, wax settings and precious stones. Thereafter, the rubber cap is removed and, in step 110, the investment compound is heated (e.g., in an oven) so that the wax evaporates, while the precious stones are maintained in their respective previous positions by the investment compound. A through-opening 58 is formed extending from a perforated flask end 60 of a hardened investment compound mold, through an empty space of the evaporated wax tree, reaching an opposite end 62 from the perforated flask end. Thereafter, a molten precious metal is poured in via the perforated flask end into the hardened investment mold (in step 112). The precious metal fills the spaces of the evaporated wax, thus replacing the evaporated wax with the precious metal and securing the precious stones therein. When the precious metal is provided at the through-opening 58, it is preferable for pressure to be applied at the perforated flask end 60 of the through-opening 58, so that the precious metal reaches distal ends of the spaces. Using the pressure-vacuum combination when the precious metal is provided at the through-opening 58, the third contacting portion 29 is formed to generate the first and third forces A and C, and therefore secure the precious stones in the setting 20, as show in FIGS. 3 and 4. In step 114, the investment compound mold is cooled down and then removed by either cracking open the investment compound mold, by dissolving the investment compound mold with a high-pressure water spray, or by immersing the investment compound mold in water to dissolve the investment compound. The completed jewelry items, and the precious stones situated therein, are completed. With the method according to the present invention, it is no longer necessary to cut grooves in the precious stone to improve the visibility and the reflection of the precious stone, while enhancing its value.

It should be noted that the setting 29 and the method according to the present invention can be provided for various articles of jewelry such as, for example, rings, pendants, earrings, bracelets, necklaces, etc. The present invention has been described in the foregoing specification with respect to specific embodiments. These embodiments serve as examples to illustrate the invention rather than to limit its scope. Modifications may be made thereto without departing from the broader teachings of the invention.

What is claimed is:

1. A setting arrangement comprising:

at least one precious stone having a facet section and a pavilion section, the facet section extending entirely around a longitudinal axis of the at least one precious stone, the pavilion section situated below the facet section; and a setting having:

a first portion contacting the facet section of the at least one precious stone at only at a single point, and a second portion contacting a contact point of the pavilion section of the at least one precious stone, the second portion cooperating with the first portion to retain the at least one precious stone, wherein the facet section of the at least one precious stone is contacted only by the first portion, and wherein the contact point of the pavilion section of the at least one precious stone is grooveless.

2. The setting arrangement according to claim 1, wherein the first portion of the setting includes a first surface contacting the facet section of the at least one precious stone at the single point, and wherein the second portion of the setting includes a second surface contacting the contact point of the pavilion section of the at least one precious stone.

3. The setting arrangement according to claim 1, wherein the first portion of the setting applies a first pressure on the at least one precious stone at the single point, wherein the second portion of the setting applies a second pressure on the at least one precious stone at the contact point, and wherein the first pressure and the second pressure cooperate to retain the at least one precious stone.

4. The setting arrangement according to claim 1, wherein the setting includes a third portion contacting a further contact point of the pavilion section of the at least one precious stone, the third portion cooperating with the first portion and the second portion to retain the at least one precious stone.

5. The setting arrangement according to claim 4, wherein the third portion of the setting includes a third surface contacting the further contact point of the pavilion section of the at least one precious stone.

6. The setting arrangement according to claim 4, wherein the first portion of the setting applies a first pressure on the at least one precious stone at the single point, wherein the second portion of the setting applies a second pressure on the at least one precious stone at the contact point, wherein the third portion of the setting applies a third pressure on the at least one precious stone at the further contact point, and wherein the first pressure, second pressure and the third pressure cooperate to retain the at least one precious stone.

7. The setting arrangement according to claim 1, wherein the facet section is not contacted by any further portion other than the first portion.

8. A setting arrangement comprising:

at least one precious stone including a first longitudinal half and a second longitudinal half, the first longitudinal half including a first facet section and a first pavilion section, the second longitudinal half including a second facet section and a second pavilion section; and a setting including:

a first portion contacting the first longitudinal half of the at least one precious stone at the first facet section, and a second portion contacting the second longitudinal half of the at least one precious stone at the second pavilion section, the second portion cooperating with the first portion to retain the at least one precious stone within the setting, wherein the second facet section of the second longitudinal half is not contacted by any portion, of the setting and wherein the second pavilion section is grooveless.

9. The setting arrangement according to claim 8, wherein the first portion of the setting includes a first surface contacting the first longitudinal half of the at least one precious stone at the first facet section, and wherein the second portion of the setting includes a second surface contacting the second longitudinal half of the at least one precious stone at the second pavilion section.

10. The setting arrangement according to claim 8, wherein the first portion of the setting applies a first pressure on the at least one precious stone at a first contact region of the first facet section, wherein the second portion of the setting applies a second pressure on the at least one precious stone at a second contact region of the second pavilion section, and wherein the first pressure and the second pressure cooperate to retain the at least one precious stone.

11. The setting arrangement according to claim 8, wherein the setting includes a third portion contacting the second longitudinal half of the at least one precious stone at the second pavilion section, the third portion cooperating with the first portion and the second portion to retain the at least one precious stone.

12. The setting arrangement according to claim 11, wherein the third portion of the setting includes a third surface contacting the second pavilion section.

13. The setting arrangement according to claim 11, wherein the first portion of the setting applies a first pressure on the at least one precious stone at a first contact region of the first facet section, wherein the second portion of the setting applies a second pressure on the at least one precious stone at a second contact region of the second pavilion section, wherein the third portion of the setting applies a third pressure on the at least one precious stone at a third contact region of the second pavilion section, and wherein the first pressure, the second pressure and the third pressure cooperate to retain the at least one precious stone.

* * * * *